US005487506A

United States Patent [19]

Drummond et al.

[11] Patent Number: 5,487,506

[45] Date of Patent: Jan. 30, 1996

[54] EASY-OPEN CONTAINER HAVING AN IMPROVED REINFORCING AND TEAR STRIP

[75] Inventors: Michael T. Drummond, Florence; Calvin G. Hill, Hartsville; Richard M. Lowman, Jr., Hartsville; William C. Suski, Hartsville, all of S.C.; Rodney W. Roberts, Otisco, Ind.; James W. Lowry, Florence, S.C.

[73] Assignee: Sonoco Products Company, Hartsville, S.C.

[21] Appl. No.: 263,556

[22] Filed: Jun. 22, 1994

[51] Int. Cl.[6] ..... B65D 85/00

[52] U.S. Cl. ..... 229/202; 229/4.5; 229/198.2

[58] Field of Search ..... 229/45, 198.2, 229/201, 202, 205, 208, 940

[56] References Cited

U.S. PATENT DOCUMENTS

| | | | |
|---|---|---|---|
| 3,144,193 | 8/1964 | Geist et al. | 229/4.5 |
| 3,153,506 | 10/1964 | Pottle | 229/202 |
| 3,157,336 | 11/1964 | Elam . | |
| 3,157,337 | 11/1964 | Elam . | |
| 3,241,739 | 3/1966 | Ahlemeyer . | |
| 3,247,869 | 4/1966 | Boegershausen et al. . | |
| 3,441,197 | 4/1969 | White | 229/202 |
| 3,506,183 | 4/1970 | Turpin et al. . | |
| 3,510,050 | 5/1970 | Culley et al. | 229/202 |
| 3,669,346 | 6/1972 | Leezer et al. . | |
| 3,972,468 | 8/1976 | Reid | 229/4.5 |
| 4,073,950 | 2/1978 | Hansen et al. | 229/4.5 |
| 4,091,718 | 5/1978 | Thornhill . | |
| 4,343,427 | 8/1982 | Sansbury | 229/4.5 |
| 5,076,440 | 12/1991 | Drummond . | |
| 5,251,809 | 10/1993 | Drummond . | |
| 5,326,023 | 7/1994 | Rice et al. | 229/202 |

*Primary Examiner*—Gary E. Elkins
*Attorney, Agent, or Firm*—Bell, Seltzer, Park & Gibson

[57] ABSTRACT

An easy-open container has a spirally-wound bodywall layer, interior barrier liner layer and outer label layer forming an easy-open seam extending spirally between the ends of the container and which is provided with an improved reinforcing and tear strip extending along the easy-open spiral seam. This reinforcing and tear strip is formed by overlapped edge portions of the label layer extending through and out of the spiral seam of the container and being folded-over onto the outside of the bodywall layer and under the label layer. Low strength bonding is provided between the overlapped label layer edge portions and high strength bonding is positioned between the superimposed label layer and folded-over a liner layer edge portion and between the superimposed label layer and bodywall layer for allowing easy starting and stripping of the reinforcing and tear strip along the spiral easy-open seam without the necessity of removing the entire label layer.

13 Claims, 4 Drawing Sheets

EASY-OPEN CONTAINER HAVING AN IMPROVED REINFORCING AND TEAR STRIP

FIELD OF THE INVENTION

This invention relates to easy-open containers for packaging products under pressure, such as biscuit and bread dough and the like. More specifically, this invention relates to an easy-open container having a spirally-wound bodywall layer, interior barrier liner layer and outer label layer forming an easy-open seam extending spirally between the ends of the container and being provided with a reinforcing and tear strip extending along the easy-open spiral seam.

BACKGROUND OF THE INVENTION

Easy-open composite containers for packaging products under pressure, particularly, refrigerated dough products and the like, constitute a significant commercial consumer product. Typically, these containers are formed of a spirally-wound paperboard or board stock bodywall layer and an interior liner layer which may be a laminate including craft paper, foil and/or polymer plys, and exterior label layer. The spirally-wound bodywall layer usually includes a butt joint formed by the adjacent edges of the bodywall layer and forming a spiral seam extending from one end of the container to the other. The exterior label layer surrounds the bodywall layer and covers or bridges the spiral seam to reinforce such seam and prevent premature opening along the spiral seam.

Commercially significant containers of this type are disclosed in commonly assigned U.S. Pat. No. 3,981,433 which is directed to a one-step easy-open container including an inner liner layer having a pleat positioned opposite the spiral butt joint. When the outer label layer is removed, the dough and liner expand outwardly together as the liner layer pleat begins to unfold and the result of pressure on the container body causes the butt joint to open. This in turn automatically allows the inner liner to expand further and automatically open by the rapidly expanding dough thereby allowing access to the dough in the interior of the container through the spirally easy-open seam of the container.

The outer label layer surrounding the spiral seam in containers of this type is an important structural component of the container because the outer label layer bridges the butt joint of the spiral seam and maintains it in closed position. Accordingly, the label layer must utilize materials which are strong enough to prevent premature opening of the container. Such structural requirements for the label layer prevent the use of more economical low strength sheet materials for construction of the label layer.

An additional problem which is present in containers of this type having easy-open spiral seams is removal of the portion of the label layer bridging such spiral seam so as to allow easy-opening thereof. Various mechanisms have been provided for removing the label layer from its bridging relationship with such easy-open spiral seam including providing a "collar cut" through the label layer and a weak adhesive between the label layer and the bodywall layer so that the label layer may be removed circumferentially around the container and totally off of the bodywall layer. This type of opening feature is shown in U.S. Pat. No. 3,241,739 which also discloses extending the liner layer through the easy-open seam and tearing such extending portion of the liner layer away as the entire label layer is removed around a collar cut to effect easy-opening.

More recently, an overlapped edge joint in the bodywall layer for the spiral seam has been proposed in commonly assigned U.S. Pat. No. 5,251,809 to provide reinforcement to the easy-open spiral seam and to allow the use of lower quality label layers. In addition, it has also been proposed in commonly assigned U.S. Pat. No. 5,076,440 to provide a folded-over portion in the label layer to extend along the butt joint of the easy-open spiral seam to reinforce such spiral seam and allow the use of generally lower quality materials in the label layer. Other devices have been proposed to assist in tearing of the label layer along the easy-open spiral seam only without removal of the entire label layer.

OBJECT AND SUMMARY OF THE INVENTION

It is the object of this invention to provide an easy-open container for packaging products under pressure and which provide an improved reinforcing and tear strip feature along the easy-open spiral seam to allow for the use of lower quality materials in the label layer and which reinforces such easy-open seam and enhances opening of the easy-open container through the tear strip which tears along the spiral seam and does not require removal of the entire label layer.

It has been found by this invention that the above object may be accomplished by providing an easy-open container particularly adapted for packaging products under pressure and which includes generally the following.

A paperboard bodywall layer in strip form is spirally-wound and defines a substantially cylindrical container having opposed ends. The bodywall layer has longitudinal edges lying adjacent each other and forming a butt joint or an overlapped skived edge joint to thereby define an easy-open spiral seam extending between the opposed ends of the container. A flexible barrier liner layer in strip form is spirally-wound inside the bodywall layer in superimposed position therewith and is wider than the bodywall layer to define longitudinal edge portions on each side thereof which extends transversely beyond the bodywall layer side edges. The liner edge portions extend through and out of the butt joint or at least one of the liner edge portions extends through a skived overlapped edge joint and is positioned on the outside of the bodywall layer in folded-over superimposed position therewith.

A flexible label layer in strip form is spirally-wound outside the bodywall layer and the folded-over liner edge portions in superimposed position therewith and has longitudinal edges overlapped with each other. The label layer is positioned in bridging relation to the easy-open spiral seam and the folded-over liner edge portions. A tab cut extends through the uppermost of the overlapped label layer edge portions and inwardly from the outer edge thereof to generally the outer edge of the folded-over liner layer edge portions to define a tear tab to be used in easy-opening of the container.

Low strength bonding means, preferably in the form of a frangible adhesive, is positioned between the overlapped label layer edge portions. High strength bonding means, preferable in the form of a permanent adhesive, is positioned between the superimposed label layer and the folded-over liner layer edge portion and between the superimposed label layer and bodywall layer for creating a reinforcing and tear strip extending from the tear tab along the easy-open spiral seam and between the outer edge of the uppermost of the overlapped label layer edge portions and the easy-open spiral seam and which includes the portion of the uppermost of the overlapped label layer edge portions and folded-over liner edge portion bonded thereto by the high strength bonding means.

Thus, an easy-open container is formed which has an improved reinforcing and tear strip extending along a spiral easy-open seam which strip reinforces such spiral seam to allow the use of lower quality materials in the label layer and which provide a tear strip which will tear through the label layer without a necessity to remove the entire label layer and expose the spiral seam for easy-opening by the pressure of the dough or other products in the container. A preferred method of manufacturing this improved easy-open container will be described in the detailed description set forth below.

BRIEF DESCRIPTION OF THE DRAWINGS

In the drawings which form a part of the original disclosure of the invention.

DETAILED DESCRIPTION OF PREFERRED EMBODIMENTS

Figure 1:
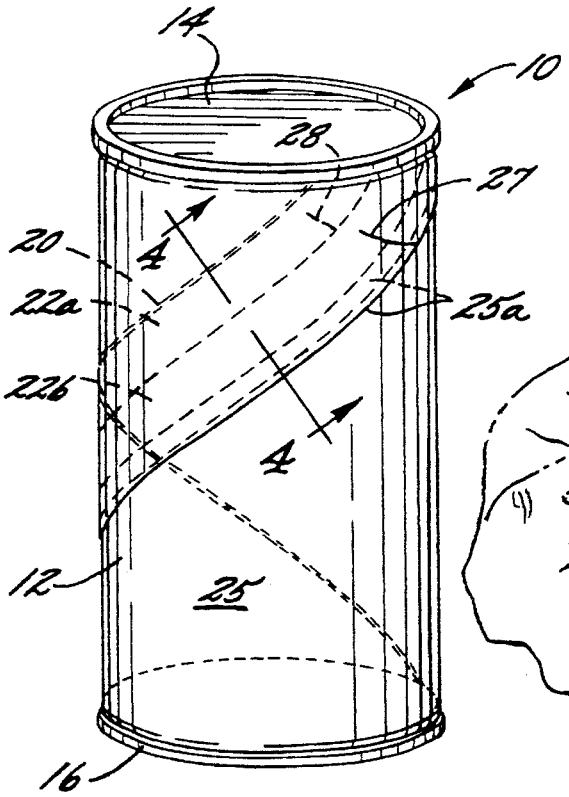
FIG. 1 is a perspective view of an easy-open container provided according to a preferred embodiment of the invention.
Figure 2:
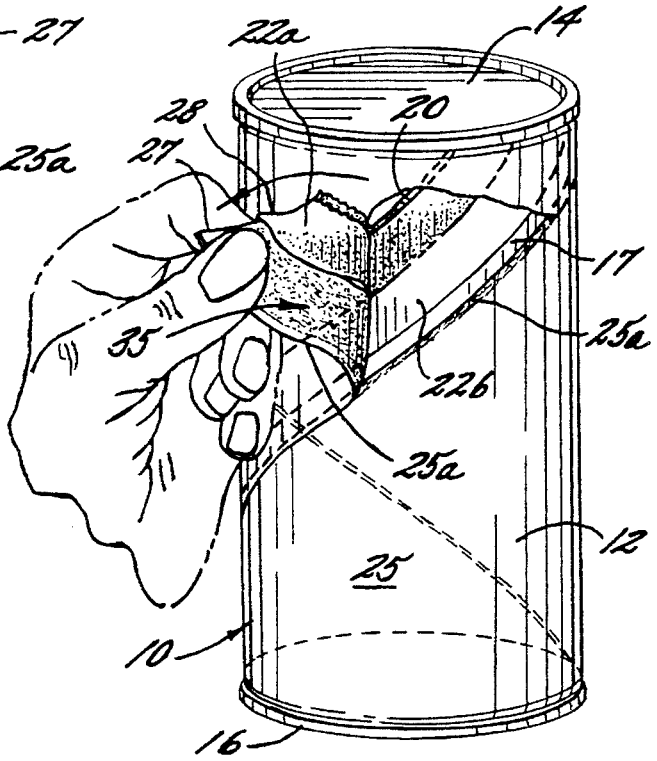
FIG. 2 is a perspective view of the easy-open container of FIG. 1 illustrating functioning of the reinforcing and tear strip as the container is being easy-opened along the spiral seam.

In the following detailed description various preferred embodiments of the invention are described. It will be understood, however, that the invention is not to be limited to its preferred embodiments and although specific terms are employed in describing the preferred embodiments, these are for the purposes of illustration only and not for purposes of limitation. It will thus be apparent that the invention includes various alternatives, modifications and equivalents within its spirit and scope as will be apparent to the skilled artisan.

FIGS. 1–6 illustrate a preferred embodiment of an easy-open container 10 constructed in accordance with the present invention. The container 10 includes a generally cylindrical body portion 12, a top end closure 14 and a bottom end closure 16. The container further includes a spirally-wound paperboard bodywall layer 17 in strip form which forms the basic shape of the cylindrical body portion 12 of the container. The bodywall layer 17 has longitudinal edges 17*a* lying adjacent each other and defining an easy-open spiral seam 20 extending between opposed ends of the body 12 and between end closures 14 and 16 of the container 10. In accordance with the embodiment of FIGS. 1–6, the longitudinal edges 17*a* of the bodywall layer 17 abut each other to form a butt joint to in turn define the spiral seam 20.

This bodywall layer 17 is advantageously composed of conventional spiral-winding paperboard or board stock having a thickness of between 0.10 and about 0.35 inch, preferably between about 0.15 and 0.30 inch, for example 0.021 inch. Board stock conventionally used in the manufacture of spirally-wound containers is commercially available from various manufacturers including Sonoco Products Company, Republic Paperboard Corporation and Middletown Board Corporation. In order to function advantageously as the spirally-wound bodywall layer 17, the board stock typically is composed of kraft or recycled paper or recycled corrugated. The board stock can typically range from, e.g. a weight of 35 to 97 pounds per 1000 square feet and a thickness of 0.010 to 0.026 inch. In some instances the board stock can include a weak exterior layer, e.g. a 0.003 inch exterior news.

The easy-open container 10 further includes a flexible barrier liner layer 22 in strip form spirally-wound inside the bodywall layer 17 in superimposed position therewith. The liner layer 22 is wider than the bodywall layers to define longitudinal edge portion 22*a* and 22*b* on each side thereof which extend transversely beyond the bodywall layer side edges 17*a*. Each of the liner layer edge portions 22*a*, 22*b* extend through the butt joint and out of the easy-open spiral seam 20 and are positioned on the outside of the bodywall layer 17 in folded-over superimposed position with each other and with the bodywall layer 17. The liner layer 22 is advantageously a barrier type, flexible sheet material, such as a polymer/foil, a kraft/foil/polymer, a polymer/polymer, or a kraft/foil laminate. The barrier layer 22 prevents the escape of liquids, oils and, preferably, gases into and out of the container bodywall 17 from the interior of the container 10.

The container 10 further includes a flexible label layer 25 in strip form spirally-wound outside the bodywall layer 17 and the folded-over liner layer edge portions 22*a*, 22*b* in superimposed position therewith and having longitudinal edge portions 25*a* overlapped with each other. The label layer 25 is positioned in bridging relationship to the easy-open spiral seam 20 and the folded-over liner layer edge portions 22*a*, 22*b*. Label layer 25 can be made of any suitable material, such as kraft paper, a polymer/foil laminate, a kraft paper/foil laminate, or the like.

The easy-open container 10 further includes a tab cut 27 extending through the upper overlapped label layer edge portion and inwardly from the outer edge thereof to generally the outer edge of the folded-over liner layer edge portion 22*a*, 22*b* to define a tear tab which can be easily lifted open and pulled by the user to initiate easy-opening of the container 10 in a manner to be described below.

Low strength bonding means 30 is positioned between the overlapped label layer edge portions 25*a* and between the folded-over liner layer edge portions 22*a*, 22*b*. High strength bonding means 32 is positioned between the superimposed label layer 25 and the upper folded-over liner layer edge portion 22*a* and between the superimposed label layer 25 and bodywall layer 17 for creating a reinforcing and tear strip 35 extending from the tear tab formed by the tear cut 27 along the easy-open spiral seam 20 and between the outer edge of the uppermost of the overlapped label layer edge portions 25*a* and the easy-open spiral seam 20 and which includes the portion of the uppermost of the overlapped label layer edge portions 25*a* and the upper of the folded-over liner layer edge portion 22*a* bonded thereto by high strength bonding means 32.

In a preferred form of this embodiment, the lowermost of the folded-over liner edge portions 22*b* is wider than the uppermost of the folded-over liner edge portion 22*a* and extends beyond the outer edge thereof. Low strength bonding means 30 is positioned between the label layer 25 and the portion of the lowermost of the folded-over liner edge portions 22*b* extending beyond the outer edge of the uppermost of the folded-over liner edge portions 22*a*. The low strength bonding means 30 positioned between the overlapped label layer edge portions and between the label layer and the portion of the lowermost of the folded-over liner edge portions 22*b* comprises a frangible adhesive. The low strength bonding means positioned between the folded-over liner edge portions 22*a*, 22*b* comprises heat sealing, and the high strength bonding means comprises a permanent adhesive.

Various adhesives can be employed as the frangible adhesive forming the low strength bonding means 30. The tear or peel strength of this frangible adhesive will vary depending on the materials used in the component layers of the container 10. The peel strength must be weak or less than the tear strength of the liner layer 22 and the label layer 25 so that the layers will peel rather than tear. With current material used, it has been found that a peel strength of 0.42 to 1.99 pounds per square inch is preferred. The frangible adhesive may include a high initial tack dextrine based adhesive commercially available from National Starch and Chemical Corporation, Grand Prairie, Tex. as "71-5626B". This is a high solids (about 64%), high viscosity (about 2100 cps) acid modified (about 2.5 Ph) dextrine adhesive. Other frangible adhesives which can be successfully used include heavily filled, resinous, aqueous emulsion type adhesives such as, for example polyvinylacetate dispersed in water together with a tackifying alcohol and an inert filler such as clay, silicon dioxide calcium carbonate, talc and the like. The inert filler can insure that a weak discrete layer of adhesive remains between the superimposed components of the container to thereby provide for the fracture or breaking of the adhesive. Weak latex can be used on some films. In the alternative, a release coating, such as a microcrystalline wax, silicone or the like can be provided on the inner surface on either or both of the superimposed components of the container so that the adhesive layer is readily released upon drying.

It is important that the frangible adhesive used for the low strength bonding means 30 have a high initial tack or adhesive so that the overlapped components between which it is positioned are held together during, and immediately following, manufacture of the container 10. It is also important that this frangible adhesive be capable of readily allowing peeling or separating of the superimposed components between which it is positioned upon easy opening of the container 10 by tearing the tear strip 35 along the easy-open seam 20. It has been found that heat sealing also accomplishes the purposes of a low strength bonding means and may be conveniently formed between the overlapped liner layer edge portions 22*a*, 22*b* during manufacture of the container 10.

Various adhesives may be employed to provide the permanent adhesive utilized for the high strength bonding means 32. The tear or peel strength of this permanent adhesive will vary depending upon the materials used in the component layers of the container 10. The tear or peel strength must be greater than the tear strength of the liner layer 22 and the label layer 25 so that these layers will tear when the tear strip 35 is torn along the easy-open spiral seam. With current materials used for these component layers, it has been found that a peel strength greater than 2.20 lbs. per square inch is necessary. The permanent adhesive may include polyvinyl alcohol with or without clay mix, blended or reactor resins, special additives, such as manufactured by H. B. Fuller and identified as A1940 having 4000 CPS viscosity, 55% solids and 5.0 pH, K6030 having 3050 CPS viscosity, 55% solids and 5.0 pH, H3935 having 5500 CPS viscosity, 52% solids and 5.0 pH, and by National Starch and identified as 32-1984 having 5400 CPS viscosity, 56% solids and 4.5 pH, and 32-0215 having 4500 CPS viscosity, 55% solids and 4.0 pH.

Figure 10:
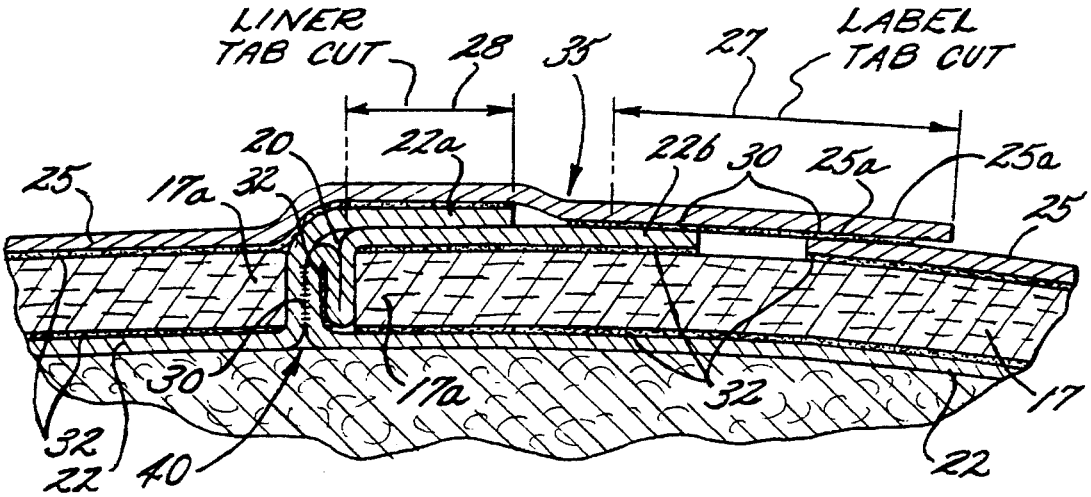
FIG. 10 is a greatly enlarged fragmentary sectional view, like FIG. 4, of a modified embodiment.

Referring now to FIG. 10, the construction of the container 10 described above with respect to FIGS. 1–6 may further include a flexible expansion joint 40 positioned in the region of the easy-open spiral seam 20 and comprised of a portion of one of the liner layer edge portions 22*b* being folded back on itself and heat sealed to the other of the liner layer edge portions 22*a*. Upon opening of the easy-open seam 20, the expansion joint 40 will expand prior to breaking to expose the contents of the container, in a manner well understood by those with ordinary skill in the art.

Figure 11:
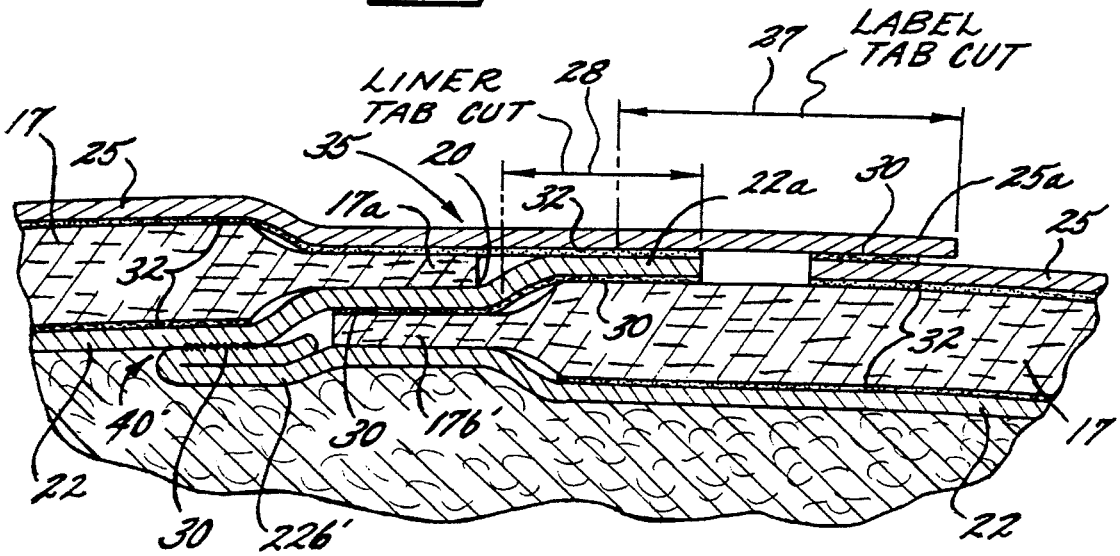
FIG. 11 is a greatly enlarged fragmentary sectional view, like FIG. 4, of an alternative embodiment.

Referring now to FIG. 11, an alternative embodiment of the container 10 is illustrated. Like reference numerals are used in this embodiment where the components of this alternative embodiment of the container 10 are the same and will not be further described with respect to this embodiment.

In this embodiment of the container 10 of FIG. 11, the longitudinal edges 17*a*' and 17*b*' of the bodywall layer 17 are in the form of longitudinal skived edges and are overlapped with each other. Skived edges, as is well understood by those with ordinary skill in the art, may be formed by compressing the edges or by grinding away or cutting away a portion of the material of the edges. The skived edges illustrated in FIG. 11 are compression skived. This embodiment also has only one of the liner layer edge portions 22*a*' extending through and out of the easy-open spiral seam 20 and positioned on the outside of the bodywall layer 17 in folded-over superimposed position therewith. The other of the liner layer edge portions 22*b*' is positioned in overlapping relationship with the other of the liner layer edge portions 22*a* on the inside of the bodywall layer 17 and may be folded back on itself to provide an expansion joint 40' and has a low strength bonding means 30 therebetween which may be in the form of heat sealing having a tear or peel strength of 3.00 to 5.00 pounds per square inch. Otherwise, this embodiment is the same and operates the same as the embodiment of FIGS. 1–6 and the embodiment of FIG. 10.

Any of the above described embodiments of this invention may also preferably include a second tab cut 28 aligned with the other tab cut 27 and extending through the uppermost of the label layer edge portions 22*a* to aid in initiating easy opening of the container 10 by tearing of the reinforcing and tear strip 35 along the spiral seam 20.

Figure 3:
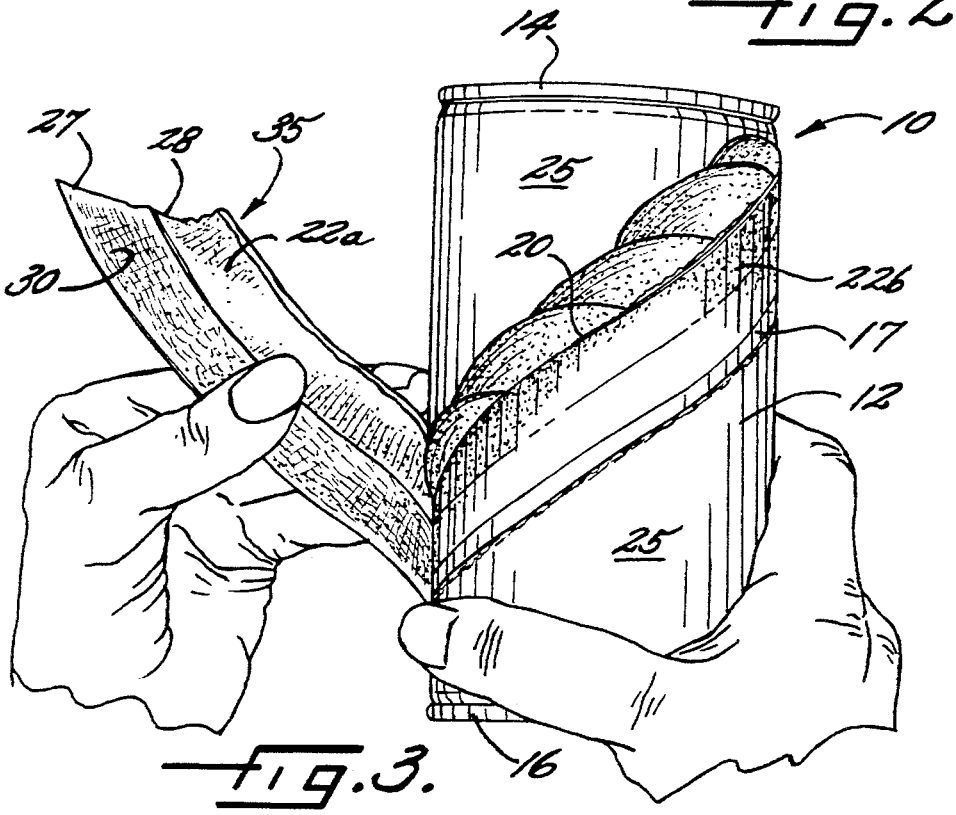
FIG. 3 is a view, like FIG. 2, illustrating a further progression in the easy-opening of the container.
Figure 4:
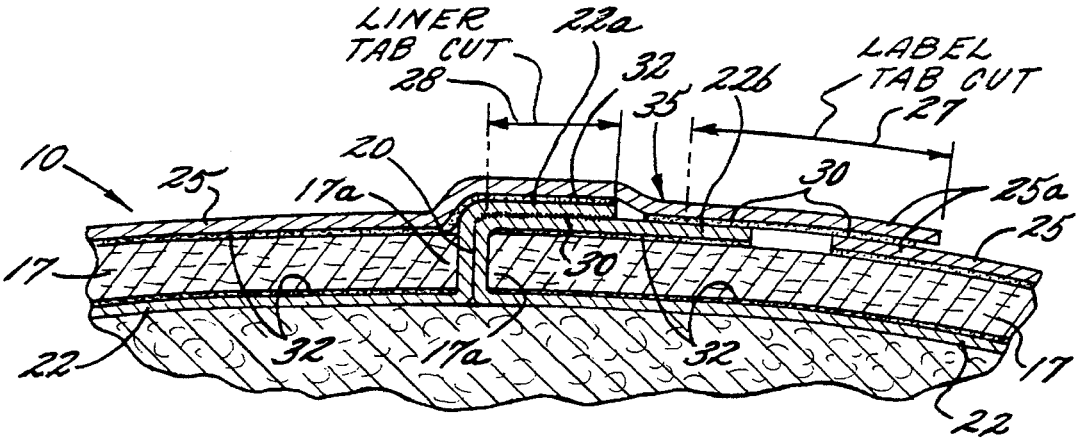
FIG. 4 is a greatly enlarged fragmentary sectional view taken generally along the Line 4—4 of FIG. 1 and illustrates the construction of the easy-open seam of the bodywall of the container together with a preferred construction of the improved reinforcing and tear strip.
Figure 5:
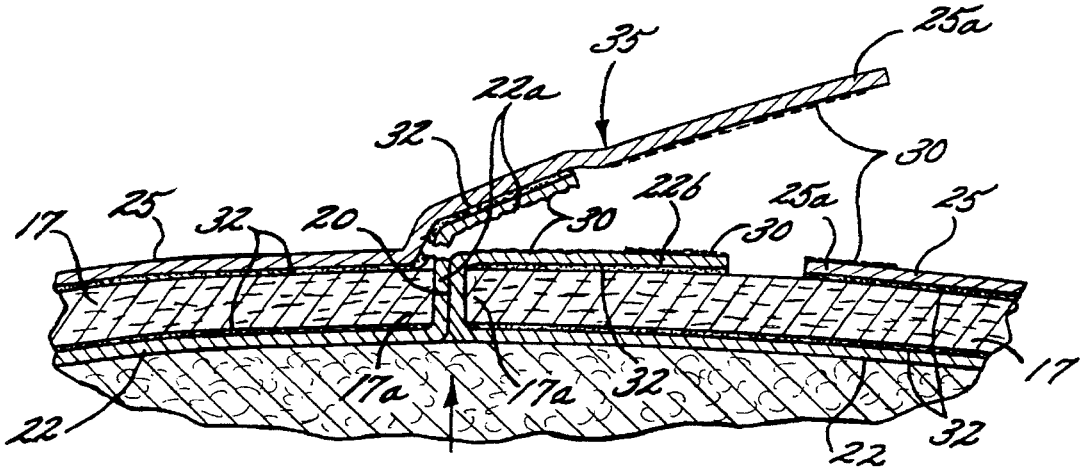
FIGS. 5 and 6 are cross-sectional views, like FIG. 4, illustrating the manner in which the container is easy-opened by tearing of the tear strip and the automatic opening of the spiral seam following removal of the tear strip and the outer label layer bridging such spiral seam.
Figure 6:
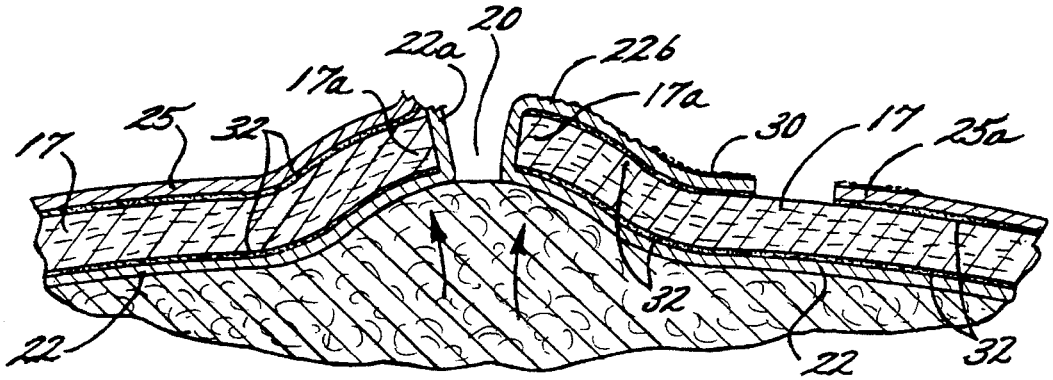

As may be seen particularly in FIGS. 4–6, the container 10 of this invention may be easy-opened by grasping the tear tab formed by the tab cut 27 and 28 which in turn initiates separation of the overlapped label edge portions 25*a* through the low strength bonding means 30 or frangible adhesive and separation of the overlapped liner layer edge portions 22*a*, 22*b* by fracturing the low strength bonding means 30 in the form of a heat seal. This will in turn cause tearing of the upper of the folded-over liner layer edge portions 22*a* at the spiral seam 20 along with the uppermost label layer edge portion 25*a* because of the strength of the high strength bonding means 32 or permanent adhesive holding the upper label layer edge portion to the upper liner layer edge portion 22*a*, holding the label layer 25 to the body layer 17 and holding the lowermost of the folded-over liner layer edge portions 22*b* to the bodywall layer 17. This causes the reinforcing and tear strip 35 to tear down along the spiral seam 20, as shown particularly in FIGS. 2 and 3. This causes the pressurized product or dough within the container 10 to expand through the spiral seam 20, as shown in FIGS. 3 and 6, to self-open the spiral seam 20 and the container 10 in a manner well understood by users of these types of containers for pressurized products.

Thus, a reinforcing and tear strip 35 has been provided in the container 10 which will initially reinforce the easy-open spiral seam 20, and which will easily separate from the components to which it is attached by fracture of the low strength bonding means 30 to tear along the spiral seam 20 for easy opening thereof without the necessity of removal of the entire label layer 25. This also allows the advantage of the use of weaker or more economical materials in the label layer than would be possible without the use of such reinforcing and tear strip 35.

Figures 7, 8, 9:
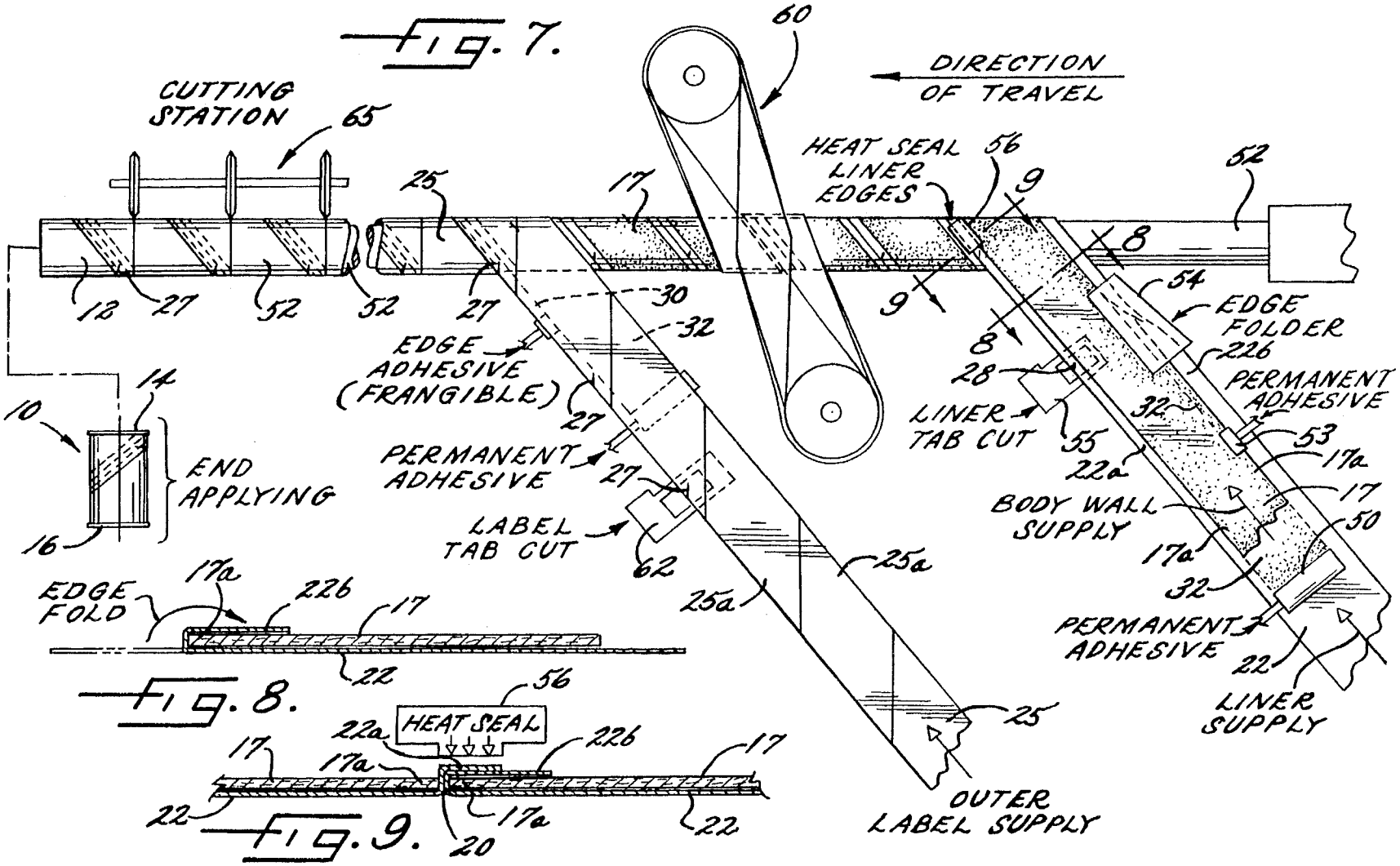
FIG. 7 diagrammatically illustrates a preferred method and apparatus for producing the easy-open container of FIGS. 1–6.
FIG. 8 is an enlarged fragmentary sectional view taken generally along the Line 8—8 of FIG. 7.
FIG. 9 is an enlarged fragmentary sectional view taken generally along the Line 9—9 of FIG. 7.

Referring now to FIGS. 7–9, a preferred method and apparatus for producing the easy-open container of FIGS. 1–6 is diagrammatically illustrated.

As may be seen, a flexible barrier liner layer 22 in strip form is provided from any suitable liner supply. A paperboard bodywall layer 17 in strip form is also provided from any suitable source. The bodywall layer 17 is of a width narrower than the liner layer 22 and is positioned on top of the liner layer 22 in superimposed position so as to define longitudinal edge portions 22*a* and 22*b* on each side of the wider liner layer 22 and which extend transversely beyond the bodywall side edge portions 17*a* when in superimposed position. Preferably, the edge portion 22*b* is wider than the edge portion 22*a*.

A high strength bonding means 32 in the form of a permanent adhesive, as described above, is applied across the central portion of the upper surface of the liner layer 22 and of a width generally the same as the width of the narrower bodywall layer 17 by a suitable roller applicator device 50 or other suitable means. The superimposed bodywall layer 17 and liner layer 22 are fed longitudinally at a desired angle to a stationary mandrel 52 and are spirally wound thereon in a manner well understood by those with ordinary skill in the art.

While the superimposed bodywall layer 17 and liner layer 22 are being fed to the mandrel 52, a high strength bonding means 32, preferably in the form of a permanent adhesive, is applied along the bodywall edge portion 17*a* adjacent to the wider liner layer edge portion 22*b* by a suitable roller adhesive applicator 53 or other suitable device and this wider liner layer edge portion 22*b* is folded over onto the adjacent bodywall edge portion 17*a* by suitable folder device 54 so that the permanent adhesive is positioned therebetween to form a high strength bond 32. A tab cut 28 is also formed in the narrower liner layer edge portion 22*a* during feeding of the superimposed bodywall layer 17 and liner layer 22 to the mandrel 52 by a suitable tab cut device 55.

As the superimposed bodywall layer 17 and liner layer 22 with folded-over liner layer edge portion 22*b* are wound onto the mandrel 52, the narrower liner layer edge portion 22*a* will overlap the folded-over liner layer edge portion 22*b* on the previous revolution of the superimposed bodywall layer 17 and liner layer 22 on the mandrel 52 so that such liner layer edge portions 22*a* and 22*b* are overlapped and superimposed with each other. A low strength bond 30 is formed between these overlapped liner layer edge portions 22*a* and 22*b* by heat sealing through a suitable heat sealer device 56. This spiral winding also forms a butt joint relationship of the edge portions 17*a* of the bodywall layer 17 to form a continuous tube having a spiral seam 20 therein and wherein each of the liner layer edge portions 22*a* and 22*b* extend through such butt joint and out of the spiral seam 20.

The thus formed continuous tube is fed forwardly along the mandrel 52 in a manner well understood by those with ordinary skill in the art by a belt device 60. During such forward feeding of the continuous tube, a flexible label layer 25 is provided from a suitable supply and is fed longitudinally at a desired angle to the mandrel 52. While the label layer 25 is being fed to the mandrel 52, a tab cut 27 is preferably cut into one of the label layer edge portions 25*a* by a suitable tab cutting device 62.

A high strength bonding means 32 in the form of a permanent adhesive is applied along the bottom surface of the label layer 25 to extend from the outer edge of one longitudinal edge portion 25*a* toward the other longitudinal edge portion 25*a* having the tab cut 27 therein, but leaving this label layer outer edge portion 25*a* uncoated with the permanent adhesive. Thereafter, a low strength bonding means 30 in the form of a frangible adhesive is applied along the bottom surface of the liner layer edge portion 25*a* which was not coated with the permanent adhesive. The label layer 25 is spirally-wound in superimposed position onto the continuous tube formed by the superimposed bodywall layer 17 and liner layer 22 in the manner discussed above so that the label layer edge portions 25*a* are in overlapped relationship with each other and have the frangible adhesive positioned therebetween for forming a low strength bonding means The label layer 25 is positioned in bridging relationship to the spiral seam 20 and the superimposed liner layer edge portions 22*a*, 22*b* on the outside of the bodywall layer 17 and in superimposed position to the remainder of the bodywall layer 17 so that the overlapped label layer edge portions 25*a* are adjacent to but not directly superimposed thereon and so that a low strength bonding means 30 is formed between the overlapped label layer edge portions 22*a* and a high strength bonding means 32 is formed between the superimposed label layer 25 and the other of the liner layer edge portions 22*a* and the superimposed label layer 25 and bodywall layer 17. The tab cuts 27 and are also positioned in alignment with each other by this spiral winding.

Thereafter, the thus spirally-wound continuous tube having bodywall layer 17, liner layer 22 and label layer 25 are fed forwardly on the mandrel 52 to a cutting station where suitable cutting devices 65 cut the continuous tube into individual lengths for containers 10. These individual container lengths may then be fed to a suitable end applying mechanisms while being filled with dough or other products under pressure so as to form filled easy-open containers 10.

Thus, it may be seen, that this invention has provided an improved easy-open container 10 which has an improved reinforcing and tear strip 35 extending along a spiral easy-open seam 20 which strip 35 reinforces the spiral seam 20 to allow the use of lower quality or lower strength materials in a label layer 25 and which provides a tear strip 35 which will tear through the label layer 25 and expose the spiral seam 20 for easy-opening by the pressure of the dough or other products in the container. A method has also been provided which may be utilized on conventional spiral winding equipment without substantial modifications or new devices therein.

The invention has been described in considerable detail with reference to its preferred embodiments. However, variations and modifications can be made within the spirit and scope of the invention as described in the foregoing specification and as defined in the following claims.

What is claimed is:

1. An easy-open container particularly adapted for packaging products under pressure and comprising:

a spirally-wound paperboard bodywall layer in strip form defining a substantially cylindrical container having opposed ends, said bodywall layer having longitudinal edges lying adjacent each other to thereby define an easy-open spiral seam extending between said opposed ends;

a flexible barrier liner layer in strip form spirally-wound inside said bodywall layer in superimposed position therewith and being wider than said bodywall layer to define longitudinal edge portion means on each side thereof which extend transversely beyond said bodywall layer side edges; said liner edge portion means extending through and out of said easy-open spiral seam and positioned on the outside of said bodywall layer in folded-over superimposed position therewith;

a flexible label layer in strip form spirally-wound outside said bodywall layer and said folded-over liner edge portion means in superimposed position therewith and having longitudinal edge portions overlapped with each other, said label layer being positioned in bridging relation to said easy-open spiral seam and said folded-over liner layer edge portion means;

a tab cut extending through the upper of said label layer edge portions and inwardly thereof to generally the outer edge of said folded-over liner layer edge portion mean to define a tear tab to be used in easy-opening of said container; and low strength bonding means positioned between said overlapped label layer edge portions, and high strength bonding means positioned between said superimposed label layer and folded-over liner layer edge portion means and between said superimposed label layer and bodywall layer for creating a reinforcing and tear strip extending from said tear tab along said easy-open spiral seam and between the outer edge of the uppermost of said overlapped label layer edge portions and said easy-open spiral seam and which includes the portion of the uppermost of said overlapped label layer edge portions and said folded-over liner layer edge portion means bonded thereto by said high strength bonding means.

2. An easy-open container, as set forth in claim 1, in which said low strength bonding means comprises a frangible adhesive, and in which said high strength bonding means comprises a permanent adhesive.

3. An easy-open container particularly adapted for packaging products under pressure and comprising:

a spirally-wound paperboard bodywall layer in strip form defining a substantially cylindrical container having opposed ends, said bodywall layer having longitudinal edges lying adjacent each other and defining an easy-open spiral seam having a butt joint and extending between said opposed ends;

a flexible barrier liner layer in strip form spirally-wound inside said bodywall layer in superimposed position therewith and being wider than said bodywall layer to define longitudinal edge portions on each side thereof which extend transversely beyond said bodywall layer side edges each of said liner layer edge portions extending through said butt joint and out of said easy-open spiral seam and positioned on the outside of said bodywall layer in folded-over superimposed position with each other and with said bodywall layer;

a flexible label layer in strip form spirally-wound outside said bodywall layer and said folded-over liner layer edge portions in superimposed position therewith and having longitudinal edge portions overlapped with each other, said label layer being positioned in bridging relation to said easy-open spiral seam and said folded-over liner layer edge portions;

a tab cut extending through the upper of said label layer edge portions and inwardly from the outer edge thereof to generally the outer edge of said folded-over liner layer edge portions to define a tear tab to be used in easy-opening of said container; and low strength bonding means positioned between said overlapped label layer edge portions and between said folded-over liner layer edge portions, and high strength bonding means positioned between said superimposed label layer and the upper folded-over liner layer edge portion and between said superimposed label layer and bodywall layer for creating a reinforcing and tear strip extending from said tear tab along said easy-open spiral seam and between the outer edge of the uppermost of said overlapped label layer edge portions and said easy-open spiral seam and which includes the portion of the uppermost of said overlapped label layer edge portions and the upper of said folded-over liner layer edge portions bonded thereto by said high strength bonding means.

4. An easy-open container, as set forth in claim 3, wherein the lowermost of said folded-over liner edge portions is wider than the uppermost of said folded-over liner edge portions and extends beyond the outer edge thereof, and wherein low strength bonding means is positioned between said label layer and the portion of the lowermost of said folded-over liner edge portions extending beyond the outer edge of the uppermost of said folded-over liner edge portions.

5. An easy-open container, as set forth in claim 4, in which said low strength bonding means positioned between said overlapped label layer edge portions and between said label layer and the portion of the lowermost of said folded-over liner edge portions comprises a frangible adhesive, said low strength bonding means positioned between said folded-over liner edge portions comprises heat sealing, and said high strength bonding means comprising a permanent adhesive.

6. An easy-open container as set forth in claim 1 or 3, including a second tab cut aligned with the other said tab cut and extending through the upper of said folded-over liner layer edge portion toward said easy-open spiral seam.

7. An easy-open container particularly adapted for packaging products under pressure and comprising:

a spirally-wound paperboard bodywall layer in strip form defining a substantially cylindrical container having opposed ends, said bodywall layer having longitudinal skied edges overlapped with each other to thereby define an easy-open spiral seam extending between said opposed ends;

a flexible barrier liner layer in strip form spirally-wound inside said bodywall layer in superimposed position therewith and being wider than said bodywall layer to define a longitudinal edge portion on each side thereof which extend transversely beyond said bodywall layer side edges; one of said liner layer edge portions extending through and out of said easy-open spiral seam and positioned on the outside of said bodywall layer in folded-over superimposed position therewith and the other of said liner layer edge portions being positioned in overlapping relation with the one of said liner layer edge portions on the inside of said bodywall layer;

a flexible label layer in strip form spirally-wound outside said bodywall layer and said folded-over liner layer edge portion in superimposed position therewith and having longitudinal edge portions overlapped with each other, said label layer being positioned in bridging relation to said easy-open spiral seam and said folded-over liner layer edge portion means;

a tab cut extending through the upper of said label layer edge portions and inwardly from the outer edge thereof to generally the outer edge of said folded-over liner layer edge portion mean to define a tear tab to be used in easy-opening of said container; and low strength bonding means positioned between said overlapped label layer edge portions and between said superimposed folded-over liner layer edge portion and bodywall layer and between said overlapped liner layer edge portions, and high strength bonding means positioned between said superimposed label layer and folded-over liner layer edge portion and between said superimposed label layer and body layer for creating a reinforcing and tear strip extending from said tear tab along said easy-open spiral seam and between the outer edge of the uppermost of said overlapped label layer edge portions and said easy-open spiral seam and which includes the portion of the uppermost of said overlapped label layer edge portions and said folded-over liner layer edge portion bonded thereto by said high strength bonding means.

8. An easy-open container, as set forth in claim 7, in which said overlapped skied edges of said bodywall layer comprise edges which have been compressed.

9. An easy-open container, as set forth in claim 7, in which said low strength bonding means positioned between said overlapped label layer edge portions and between said superimposed folded-over liner layer edge portion and bodywall layer comprises frangible adhesive, said low strength bonding means positioned between said overlapped liner layer edge portions comprises heat sealing, and said high strength bonding means comprises permanent adhesive.

10. An easy-open container, as set forth in claim 1, 3 or 7, in which one of said liner layer edge portions is folded back on itself and heat sealed to the other of said liner layer edge portions to define an expansion joint positioned in the region of said easy-open spiral seam.

11. An easy-open container, as set forth in claim 2, 5 or 9, in which said frangible adhesive comprises an adhesive having a peel strength less than the tear strength of said liner layer and said label layer.

12. An easy-open container, as set forth in claim 2, 5 or 9, in which said permanent adhesive comprises an adhesive having a peel strength greater than the tear strength of said liner layer and said label layer.

13. An easy-open container, as set forth in claim 2, 5 or 9, in which said frangible adhesive comprises an adhesive having a peel strength less than the tear strength of said liner layer and said label layer, and said permanent adhesive comprises an adhesive having a peel strength greater than the tear strength of said liner layer and said label layer.

* * * * *